United States Patent [19]

Ross

[11] 4,065,874

[45] Jan. 3, 1978

[54] CARTESIAN TOY SUBMARINE

[76] Inventor: Hubertus R. Ross, 7601 Salem Church Road, Richmond, Va. 23234

[21] Appl. No.: 802,850

[22] Filed: June 2, 1977

[51] Int. Cl.[2] ..... A63H 23/06

[52] U.S. Cl. ..... 46/94; 46/95; 272/8 N

[58] Field of Search ..... 273/1 L; 272/8 N, 8 R, 272/8 D; 46/91, 92, 93, 94, 95, 44; 40/106.25

[56] References Cited

U.S. PATENT DOCUMENTS

| | | | |
|---|---|---|---|
| 670,727 | 3/1901 | Poli | 46/94 |
| 1,257,151 | 2/1918 | Tierney | 46/95 |
| 1,662,998 | 3/1928 | Brown | 46/95 |
| 2,509,112 | 5/1950 | Seaman | 272/8 N |
| 2,525,232 | 10/1950 | McGaughy | 272/8 N |
| 3,364,617 | 1/1968 | Grafe | 46/95 |
| 3,695,607 | 10/1972 | Stouffer | 46/94 X |

FOREIGN PATENT DOCUMENTS

| | | | |
|---|---|---|---|
| 6,557 of | 1915 | United Kingdom | 46/94 |
| 417,317 | 10/1934 | United Kingdom | 46/44 |

*Primary Examiner*—Richard C. Pinkham
*Assistant Examiner*—Arnold W. Kramer
*Attorney, Agent, or Firm*—Norman B. Rainer

[57] ABSTRACT

An essentially non-compressible cartesian toy submarine is provided which, when submersed in a liquid confined within a pressurized vessel, has the ability to ascend, descend and travel in a lateral plane in response to minor variations in pressure imposed within the vessel. The toy is comprised of a hull having a streamlined bow and a vertically tapered stern. An air-holding chamber, centrally positioned on the upper portion of the hull, has an aperture in its lowermost portion located within the hull. A channel extends through the rear portion of the hull, communicating with said air-holding chamber and the exterior of said hull. The channel is preferably straight and angled downwardly and sidewardly with respect to the longitudinal axis of the hull.

5 Claims, 4 Drawing Figures

CARTESIAN TOY SUBMARINE

BACKGROUND OF THE INVENTION

This invention relates to a toy, and more particularly to improvements in a cartesian type of toy capable of being propelled in a controllable manner while submersed in a liquid such as water.

Small cartesian diving devices, designed to function in transparent chambers containing water and capable of being pressurized, are well known as toys for amusement purposes. The devices are generally constructed as bodies capable of undergoing changes in their volume in response to an applied hydrostatic pressure, thereby displacing a variable quantity of the suspending liquid, or as hollow bodies that admit or expel liquid in response to hydrostatic pressure to alter the weight of the body. In general, with increased pressure, the weight of the body becomes slightly greater than the weight of the liquid displaced thereby, causing a descending motion. With decreased pressure, the body becomes slightly lighter than the weight of displaced liquid, causing ascending motion.

While prior toys of this type have been amusing, they have not generally been endowed with movement capabilities other than straight descent and ascent. To secure and maintain a child's interest, other features of movement, functionality or controllability are necessary. Although prior efforts have been directed toward the development of cartesian toys of improved versatility, such toys have involved interactively moving components of generally intricate design. Toys of such construction are costly, unreliable, or demanding of frequent maintenance.

A preferred form of cartesian toy is a miniature submarine. One such embodiment, described in U.S. Pat. No. 2,402,081 is capable of ascent and descent movement, with a slightly inclined position being achievable during said movements. A highly desirable mode of action of a toy submarine would be controlled movement in a lateral plane, but this has not heretofore been successfully accomplished in a practical manner. Lateral movement of a cartesian toy has been disclosed for example in U.S. Pat. No. 3,382,606, but such mode of movement is achieved therein only by virtue of a propeller operated in conjunction with a complex multicomponent device.

It is accordingly an object of the present invention to provide a cartesian toy of simple construction capable of controlled lateral movement in a liquid confined within a pressurized vessel. It is another object to provide a cartesian toy in the form of a submarine capable of controlled lateral movement in response to pressure variations applied to a liquid in which it is submersed. It is a still further object of the present invention to provide a cartesian toy in the form of a submarine having no moving parts and capable of ascent, descent and lateral movement in a liquid confined in a pressurized vessel, said movements being produced in response to pressure variations. These objects and other objects and advantages of the invention will be apparent from the following description.

SUMMARY OF THE INVENTION

The objects of the present invention are accomplished in general by providing a miniature toy submarine of non-compressible construction having an elongated cylindrical hull and an air-holding chamber centrally disposed on the upper side of said hull. The forward or bow end of the hull is tapered or otherwise streamlined to minimize resistance to forward motion through a liquid medium. The rear or stern end of the hull tapers to a vertically disposed terminus as a result of the convergence of two essentially vertically disposed opposing surfaces. A capillary-like channel extends through the rear portion of the hull, communicating with said air-holding chamber and the exterior of said hull. The channel is preferably straight and angled downwardly and sidewardly with respect to the center longitudinal axis of the hull, preferably emerging from the hull within one of said opposing surfaces.

BRIEF DESCRIPTION OF THE DRAWING

In the accompanying drawing forming a part of this specification and in which similar numerals of reference indicate corresponding parts in all the figures of the drawing.

DETAILED DESCRIPTION OF THE INVENTION

Figure 1:
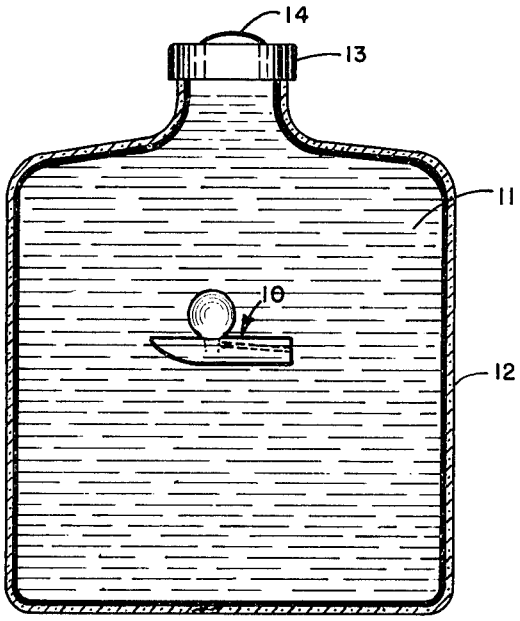
FIG. 1 illustrates an embodiment of the cartesian toy of this invention submersed in liquid within a sealed vessel.

Referring to FIG. 1, a cartesian toy submarine 10 of the present invention is submersed in the transparent liquid 11 confined within transparent vessel 12. An air-tight enclosure 13 is provided at the mouth of vessel 12, said enclosure being provided with a resiliently displaceable diaphram 14.

The submarine 10 has an essentially cylindrical hull 15, having a streamlined bow 20. The stern portion 21 is comprised of opposed surfaces 24 and vertically disposed terminus 25. A rigid air confining chamber 16 is mounted on the upper portion of said hull essentially midway along the length thereof. Said chamber contains a downwardly directed constricted neck 23 disposed within reservoir 19 on the upper portion of said hull. At the bottom of said neck is an aperture 18 which permits liquid to enter the chamber. A channel 17, communicating with reservoir 19, extends rearwardly at a downward angle through hull 15, emerging through one of the opposed surfaces 24 of stern portion 21.

Figure 2:
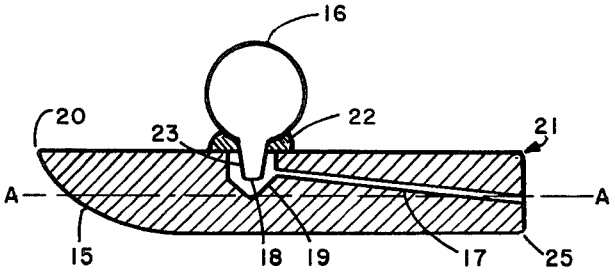
FIG. 2 is an enlarged longitudinally transverse side view of the toy of FIG. 1.

The hull 15 may be comprised of a rigid plastic material such as polyethylene, polystyrene, polyvinylchloride, polyacrylate and the like. Fabrication of the hull may be achieved either by direct molding techniques, or shaping operations beginning with a cylindrical rod form. Although the terminus 25 of stern portion 21 is shown in FIG. 2 to be straight, fishtail and other configurations may be utilized while still retaining a disposition in a plane passing vertically through axis A—A.

Figure 4:
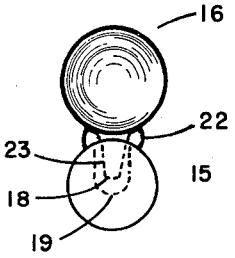
FIG. 4 is a front view of the toy of FIG. 2.

The chamber 16 may be fabricated of glass or rigid plastic materials of the type useful for fabrication of the hull. The entire toy may in fact be made via injection molding or other forming techniques generally employed in the manufacture of articles from thermoplastic polymers. The chamber 16 illustrated in the drawing, particularly as shown in FIGS. 2 and 4, consists of a substantially spherical bulb-like structure which is attached to the hull 15 by an adhesive sealant forming a continuous annular ring 22 contiguous to both the hull and the chamber. The volumetric capacity of the chamber, in relation to the size and density of the hull is such that the toy will have neutral density in the suspending ldiquid when the chamber is about half filled with said liquid.

The downward angle of channel 17, measured between the longitudinal center axis of the hull (represented as line A—A in FIGS. 2 and 3) and the center axis of channel 17 is a critical feature of the toy of this invention and will range between about 2° and 10°. The channel preferably has a circular cylindrical configuration and has a diameter preferably between about 1/32 inch and 1/16 inch. The diameter of aperture 18 may be approximately equal to the diameter of channel 17, although in preferred embodiments, the diameter of aperture 18 is up to 100% larger than the diameter of said channel. The aperture may be disposed to open downwardly, or preferably sidewardly wherein it may constitute the entrance to channel 17.

Figure 3:
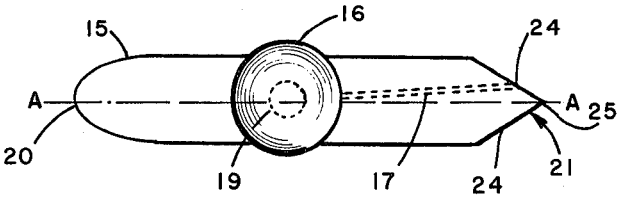
FIG. 3 is a top plan view of the toy of FIG. 2.

The sideward direction taken by the downwardly angled channel 17 is for the purpose of placing the site of emergence of said channel on either side of stern portion 21. This provides a rudder-like effect to steer the submarine in a circular path. For example, placement of channel 17 as shown in FIG. 3 will cause the submarine to travel in a circular direction which is clockwise when viewed from above. Conversely, emergence of channel 17 from the side of stern portion 21 opposite to that of FIG. 3, will cause circular movement in a counterclockwise direction.

In operation, the toy submarine is placed in a vessel 12, which may be a gallon-sized bottle of common design, nearly filled with water. The bottle is then sealed by a rubber disc diaphram 14 held in place by a screw-on bottle cap having a circular opening of ½ to 1 inch diameter in its top. By tapping on the rubber disc strongly and abruptly, water is caused to enter reservoir 19 of the submarine through channel 17. Because of the critical spatial and geometric interrelationships of the chamber 16, constricted neck 23, aperture 18 and reservoir 19, air is permitted to be pulsatingly displaced out of chamber 16, thereby enabling entrance of water. When chamber 16 is about half filled with water, the submarine will achieve neutral density in the water and will be horizontally oriented, namely oriented with its longitudinal center axis A—A in a horizontal plane.

After neutral buoyancy has been achieved, further pressure increase within the sealed bottle, as by depressing the rubber disc, will cause descent of the submarine. Lessening of the pressure, as by permitting the disc to resume its upper or unstressed position, will cause ascent of the submarine. The total absolute pressure on the submarine is the sum of the hydrostatic pressures exerted by the height of water above the submarine and the air above the water. Although the absolute pressure on the submersed toy submarine will vary with its depth, pressures ordinarily will not exceed 5 lbs/sq. in. beyond atmospheric pressure. The pressure fluctuations of the controlling manipulations of the diaphram or other pressure-adjusting means will generally be less than 2 lbs/sq. in. and preferably less than 0.5 lbs/sq. in. and within the realm of achievement by finger pressure applied to a diaphram device.

The term "communicating", as used herein to describe the disposition of one end of the capillary channel 17 with respect to the chamber 16, is intended to indicate that air or liquid can pass unimpeded between the two structural entities. However, as described hereinabove, in at least one embodiment there may be an intervening reservoir 19. Such embodiment is still contemplated as being within the purview of the term "communicating".

Lateral movement of the submarine in a circular path is achieved by applying a series of reasonably constant depression and release displacements to the disc, such as by a rhythmic tapping. Although it is not intended to limit the scope of the present invention to any particular theoretical interpretation, it is felt that one possible explanation for the phenomenon of lateral movement is that small quantities of water are expelled from channel 17 during momentary pressure releases. causing a propulsive effect, and the reverse action of water re-entering the channel exerts a forward push on the bottom of the channel to produce an additional propulsive effect.

In consequence of the lateral movement capability, the submarine can be made to travel in controllable lateral circles or spirals at any desired depth in the vessel. The circular motion is produced by the emergence of channel 17 in one of the opposed surfaces 24, and a circular path can be achieved without having the submarine strike the wall of the bottle. By utilizing two or more submarine toys, each being fashioned for movement in opposite directions, manipulation of the rubber disc will produce simultaneous contra-rotational paths of the submarines. Because the toy submarines have no moving parts or parts subject to corrosive deterioration by water, they are capable of very enduring and reliable utilization.

While particular examples of the present invention have been shown and described, it is apparent that changes and modifications may be made herein without departing from the invention in its broadest aspects. The aim of the appended claims, therefore, is to cover all such changes and modifications as fall within the true spirit and scope of the invention.

Having thus described my invention, what is claimed is:

1. A toy submarine comprising an elongated cylindrical hull having a bow configuration streamlined to minimize resistance to forward motion through a liquid medium and a stern portion which tapers to a vertically disposed terminus as a result of the convergence of two essentially vertically disposed opposing surfaces, a rigid air-holding chamber substantially centrally positioned on the upper portion of said hull, said chamber having an aperture in a lower portion thereof located within said hull, and a straight cylindrical channel within said hull communicating with said chamber and emerging from one of said opposing surfaces, said channel having a downwardly angled orientation in going from said chamber to said surface.

2. The toy submarine of claim 1 fabricated and dimensioned in a manner such that said submarine achieves neutral density in water when said chamber is essentially half filled with water.

3. The toy submarine of claim 1 wherein said air-holding chamber is substantially spherical and has a constricted neck at a lower portion thereof which terminates within said hull, said aperture being located within said neck.

4. The toy submarine of claim 3 wherein said neck is seated within a reservoir disposed within the upper portion of said hull and adapted to cause pulsating entrance of water into said chamber in response to pressure fluctuations applied to said toy when submersed in water.

5. The toy submarine of claim 1 wherein said channel emerges from one of said opposing surfaces at a site below the center longitudinal axis of said cylindrical hull.

* * * * *